US008517006B2

(12) United States Patent
Frock et al.

(10) Patent No.: US 8,517,006 B2
(45) Date of Patent: Aug. 27, 2013

(54) STACKED STEAM OVEN CONSTRUCTION

(75) Inventors: Jeffrey L. Frock, Troy, OH (US); Larry W. Lyons, Hillsboro, OH (US); Atul Saksena, Troy, OH (US)

(73) Assignee: Premark FEG. L.L.C., Glenview, IL (US)

( * ) Notice: Subject to any disclaimer, the term of this patent is extended or adjusted under 35 U.S.C. 154(b) by 706 days.

(21) Appl. No.: 12/252,667

(22) Filed: Oct. 16, 2008

(65) Prior Publication Data

US 2010/0095944 A1 Apr. 22, 2010

(51) Int. Cl.
*F24C 15/36* (2006.01)

(52) U.S. Cl.
USPC ..... 126/201; 126/20; 126/273 R; 29/897.3; 219/401; 219/394; 248/678; 248/673; 248/346.01

(58) Field of Classification Search
USPC ..... 126/20.1, 20, 273 R; 29/897.3; 219/401, 219/394; 248/678, 673, 346.01
See application file for complete search history.

(56) References Cited

U.S. PATENT DOCUMENTS

| | | | | |
|---|---|---|---|---|
| 3,033,188 | A | 5/1962 | Cline et al. | |
| 3,367,043 | A | 2/1968 | Torigian | |
| 3,701,456 | A | 10/1972 | Alroy | |
| 3,777,118 | A * | 12/1973 | Creus | 219/394 |
| 4,699,119 | A | 10/1987 | Benko et al. | |
| 5,368,008 | A | 11/1994 | Oslin | |
| 5,619,983 | A | 4/1997 | Smith | |
| 5,988,154 | A * | 11/1999 | Douglas et al. | 126/20.1 |
| 5,996,841 | A | 12/1999 | Marrocco | |
| 7,028,964 | B2 * | 4/2006 | Baechle | 248/346.01 |
| 7,546,927 | B2 * | 6/2009 | Lowry et al. | 211/126.1 |
| 2003/0220848 | A1 | 11/2003 | Behrendt | |
| 2006/0049725 | A1 | 3/2006 | Simon | |
| 2007/0175885 | A1 | 8/2007 | Brower et al. | |
| 2008/0308709 | A1 * | 12/2008 | Tartan et al. | 248/678 |

FOREIGN PATENT DOCUMENTS

| | | | |
|---|---|---|---|
| CN | 1594968 | A | 3/2005 |
| CN | 20101441 | Y | 1/2008 |
| CN | 201028486 | Y | 2/2008 |

OTHER PUBLICATIONS

International Search Report and Written Opinion, International Application No. PCT/US2009/059625 (10 pages) (Dec. 1, 2009).
International Preliminary Report on Patentability, International Application No. PCT/US2009/059625 (Apr. 28, 2011).

* cited by examiner

*Primary Examiner* — Avinash Savani
(74) *Attorney, Agent, or Firm* — Thompson Hine L.L.P.

(57) ABSTRACT

A stacked steam oven construction with a nested stacking component is described.

11 Claims, 5 Drawing Sheets

STACKED STEAM OVEN CONSTRUCTION

TECHNICAL FIELD

The present application relates generally to steam ovens for steaming food products and, more specifically, to a stack steam oven configuration.

BACKGROUND

Steam cookers have been successfully employed by schools, restaurants, hospitals, universities and other food service operations to prepare quickly and conveniently large quantities of food. Different food service operations have different needs and therefore steam ovens are available in a variety of sizes and capacities. For example, it is known to provide steam ovens with a single steam cavity. It is also known to provide steam ovens with two steam cavities, one arranged above the other. Steam oven manufacturers therefore have a need to be flexible in terms of product offerings.

SUMMARY

In one aspect, a steam oven assembly includes a first steam oven including a housing having a top, a bottom and sides extending from the top to the bottom. A cooking cavity is within the housing and a door is provided having an open configuration and a closed configuration. A second steam oven includes a housing having a top, a bottom and sides extending from the top to the bottom. A cooking cavity is within the housing and a door is provided having an open configuration and a closed configuration. The second steam oven is stacked on top of the first steam oven. A stacking component is located between the first and second steam ovens. The stacking component includes a seating surface on which the second steam oven sits. The stacking component nests with the top of the first steam oven or the bottom of the second steam oven to inhibit sliding movement of the second steam oven relative to the first steam oven.

In another aspect, a steam oven assembly includes a steam oven including a housing having a top, a bottom and sides extending from the top to the bottom. A cooking cavity is provided within the housing and a cavity door has an open configuration and a closed configuration. A base component is secured to the bottom of the steam oven. The base component includes a seating surface engaged with the bottom of the steam oven and four perimeter side walls extending downward from the seating surface to form and upwardly extending cavity at the bottom of the base component.

In a further aspect, a method of assembling a stacked steam oven construction involves: (a) providing a first steam oven including a housing having a top, a bottom and sides extending from the top to the bottom, a cooking cavity within the housing and a door having an open configuration and a closed configuration; (b) providing a second steam oven including a housing having a top, a bottom and sides extending from the top to the bottom, a cooking cavity within the housing and a door having an open configuration and a closed configuration; (c) securing a stacking component to the bottom of the first steam oven, the stacking component including a downward facing cavity; (d) stacking the first steam oven atop the second steam oven such that the downward facing cavity of the stacking component nests with the top of the second steam oven to inhibit sliding movement of the second steam oven relative to the first steam oven.

DETAILED DESCRIPTION

Figure 1:
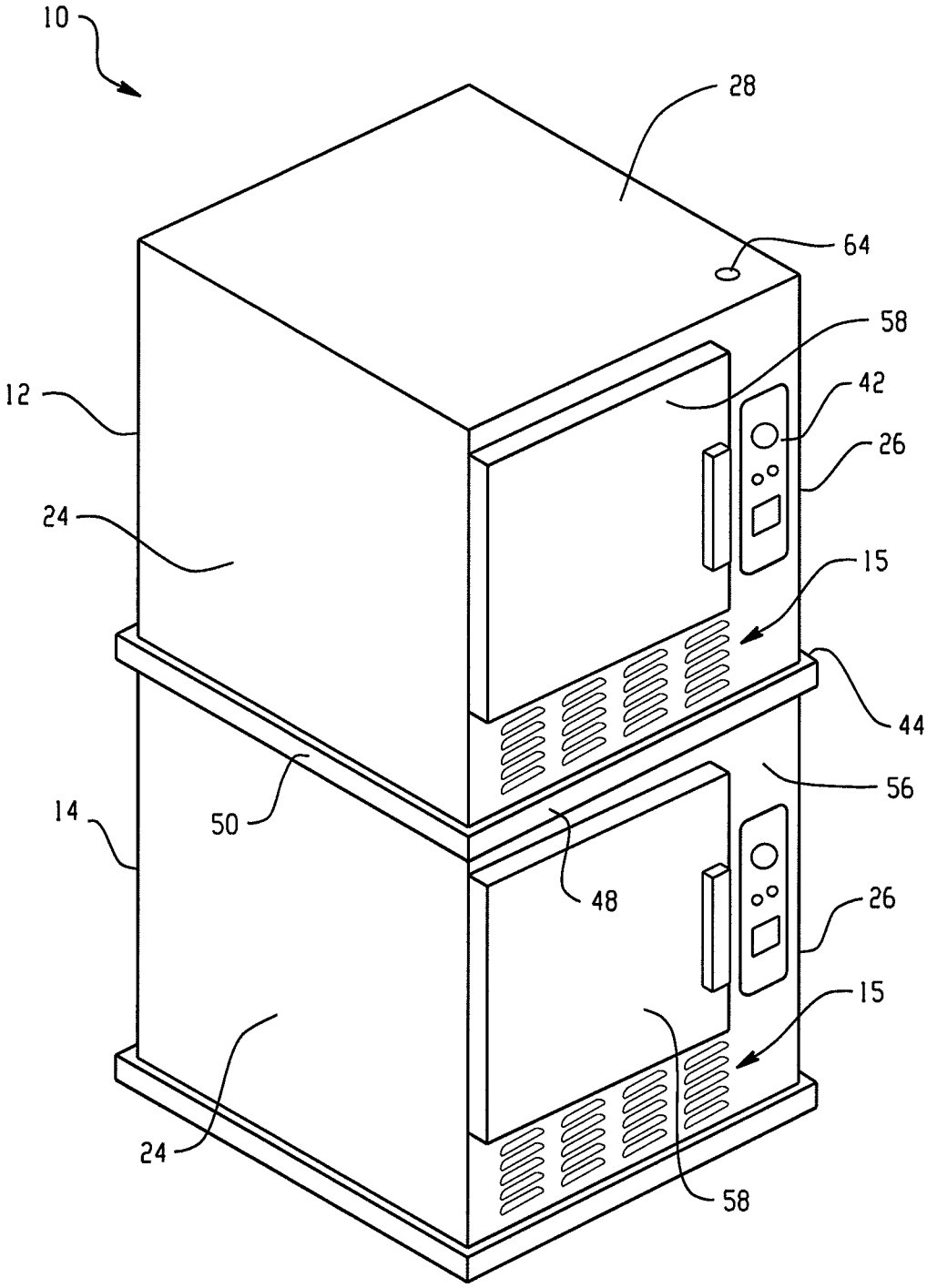
FIG. 1 is a perspective view of an embodiment of a stacked steam oven assembly.

Referring to FIG. 1, a double cavity steam oven assembly 10 includes an upper steam oven unit 12 and a lower steam oven unit 14. Each steam oven unit 12 and 14 includes a steam generator 15. In other embodiments, a separate steam generator is provided for feeding both ovens.

In one example, the steam oven units 12 and 14 may be formed to include a substantially box-shaped cooking cavity 22 defined by cavity walls internal of the external housing, which housing includes left 24, right 26, top 28, bottom 30 and rear 32 walls. A front access opening 34 is provided for the cavity. A front, generally rectangular panel 40 frames the front access opening (behind door 58 having open and closed configurations) and has one or more control panel openings 42 located to one side of the opening.

Figure 2:
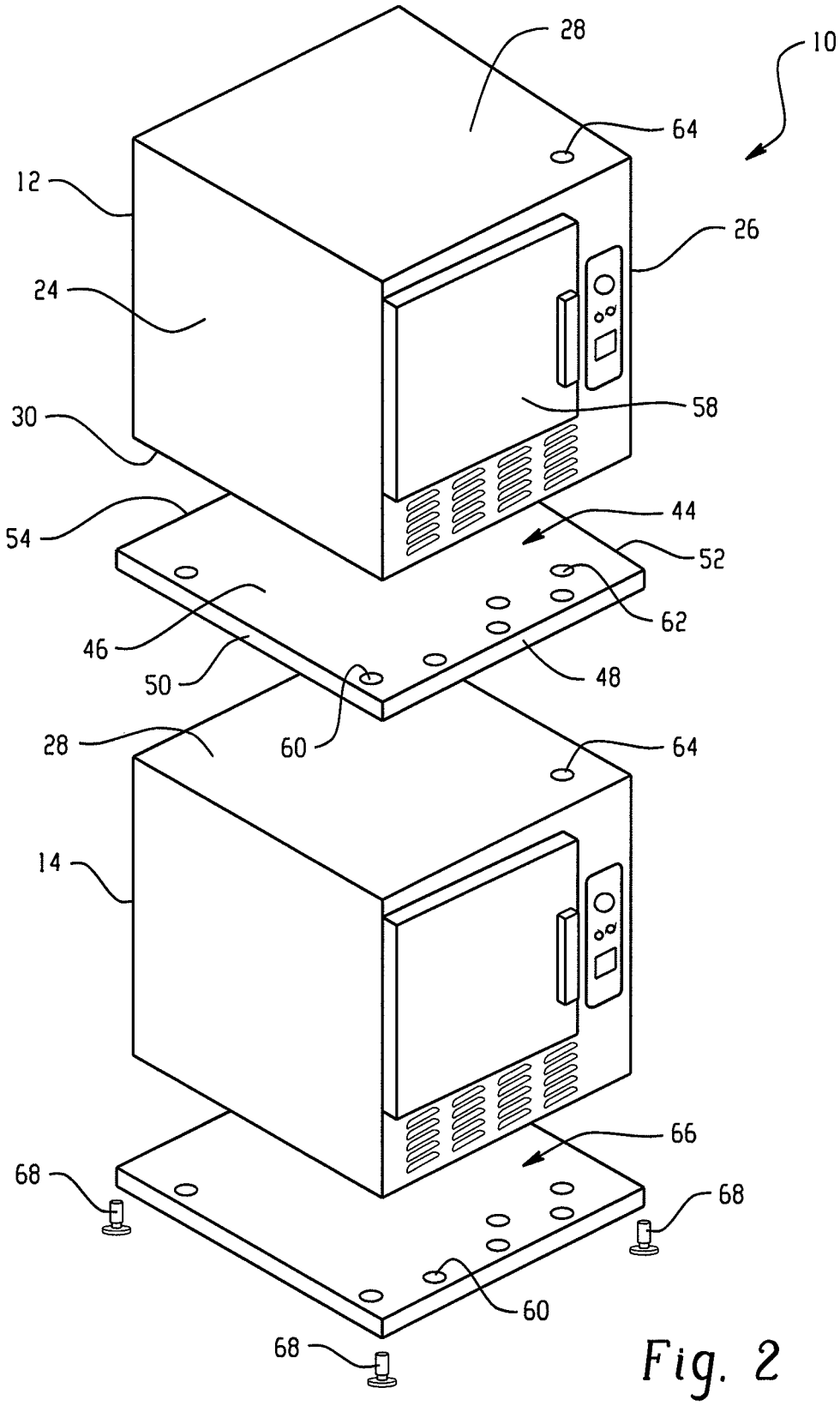
FIG. 2 is an exploded, perspective view of the steam oven assembly of FIG. 1.

Referring also to FIG. 2, the oven assembly 10 includes a stacking component 44 located between the upper oven unit 12 and the lower oven unit 14. The stacking component 44 includes a substantially planar seating surface 46 and side walls 48, 50, 52 and 54 extending downwardly from the seating surface.

Figure 3:
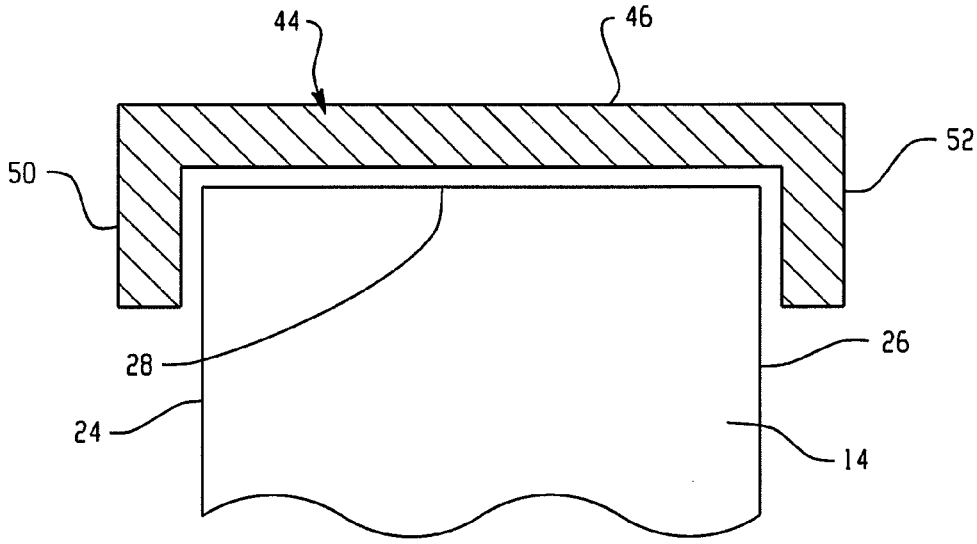
FIG. 3 is a diagrammatic section view illustrating nesting of a nesting component with a lower steam oven unit of FIG. 1.

Referring also to FIG. 3, the seating surface 46 and the side walls 48, 50, 52 and 54 are sized and arranged to nest with the top wall 28 of the lower oven unit 14 such that the seating surface spans the top wall and the side walls 48, 50, 52 and 54 extend alongside the front 56, right 28, rear 32 and left 24 walls. In other words, the distances between opposing side walls 50 and 52, 48 and 54 of the stack component are greater than the corresponding dimensions of the top wall 28 of the lower oven unit 14. As can be seen from FIG. 1, at least one side wall 48 has a height selected such that the side wall 48 does not interfere with the door 58 of the lower oven unit 14.

Referring to FIG. 2, the stacking component 44 includes openings 60 that receive legs or projections extending downwardly from the bottom 30 of the upper oven unit 12. In another embodiment, the stacking component 44 may not receive legs extending downwardly from the bottom of the upper oven unit 12 (e.g., fasteners may be passed upwardly through the component to secure it to the upper oven unit). In one embodiment, the seating surface 46 of the stacking component 44 includes a high friction material located thereon to inhibit sliding of the upper oven component 12 relative to the stacking component 44.

Figure 4:
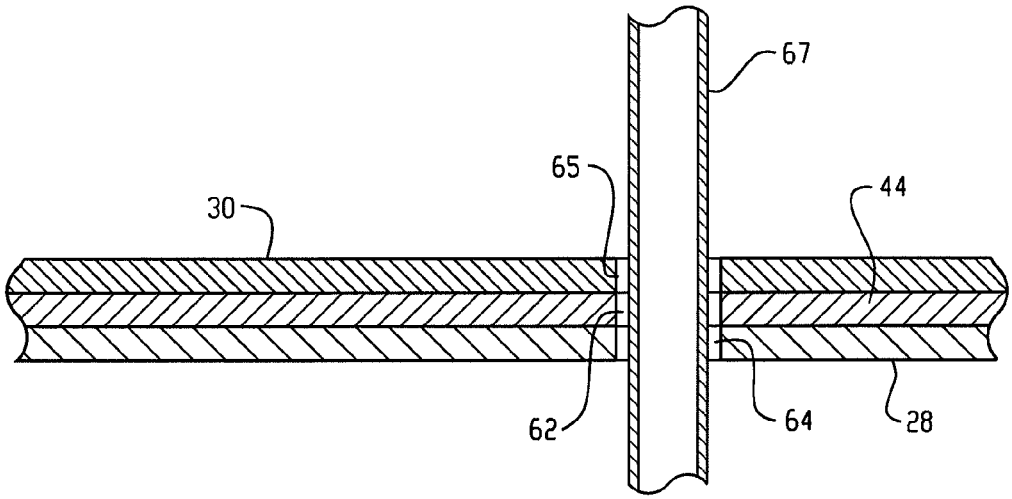
FIG. 4 is a diagrammatic section view of the steam oven assembly with a conduit passageway formed between stacked ovens.

Stacking component 44 also includes an opening 62 that is used to align with opening 64 in the top wall 28 of the lower oven unit 14 and a corresponding opening 65 in the bottom 30 of the upper oven unit 12. Referring briefly to FIG. 4, the opening 62 allows a conduit 67 (e.g., a delime conduit) to extend from the lower oven unit 14 to the upper oven unit 12 by passing through the opening 62 in the stacking component 44. In some embodiments, multiple openings are provided in the bottom 30 of the upper oven unit 12, through the seating surface of the stacking component 44 and in the top of the lower oven unit 14 so that multiple conduits pass between the upper and lower oven units.

A base component 66 is used to support the lower oven unit 14. The structure of the base component 66 may be similar or even identical to the stacking component 44. Legs or casters 68 (e.g., six casters) are mounted to the lower oven unit 14 through openings 60 in the base component 66. The casters 68 are used to support the lower oven unit 14 off the floor (e.g., a distance of at least about six inches).

Use of identical components 66 and 44 can allow for interchangeability of the two components in that the component 66 may be used as a stacking component and the component 44 may be used as a base component. The oven unit 12 can be used as the lower oven unit and the oven unit 14 can be used as the upper oven unit. This interchangeable arrangement can simplify assembly of the steam oven assembly 10. The components 66 and 44 also provide a buffer or a shield to reduce damage to the oven units 12 and 14 due to sliding contact with each other or the floor.

The components 44 and 46 can be formed by any suitable process such as by cutting and bending a sheet material (e.g., of stainless steel) into the desired configuration. The openings my be punched through the sheet material.

Figure 5:
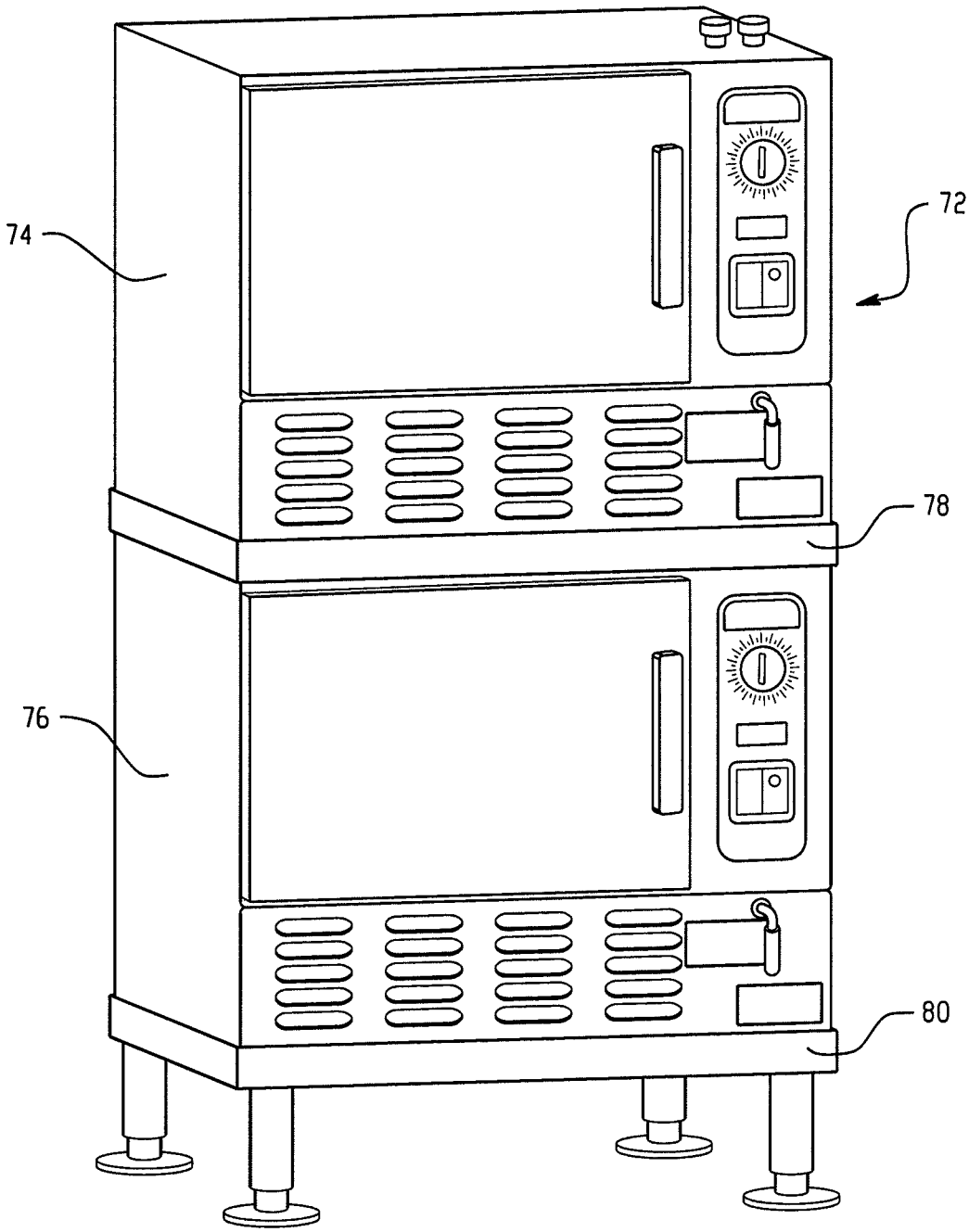
FIG. 5 illustrates another embodiment of a double cavity steam oven assembly.

It is to be clearly understood that the above description is intended by way of illustration and example only, is not intended to be taken by way of limitation, and that various changes and modifications are possible. For example, while the stacking component 44 is described as nesting with the lower oven 14, the stacking component could be secured to the lower oven 14 and face upward such that it nests with the bottom of the upper oven component 12. FIG. 5 shows another embodiment of a steam oven assembly 72 similar to the steam oven assembly 10 described above including upper steam oven unit 74, lower steam oven unit 76, stacking component 78 and base component 80. While two oven units are described above, stacked one on top of the other, more than two units may be stacked, such as three oven units or more stacked one on top of the other.

Figure 6:
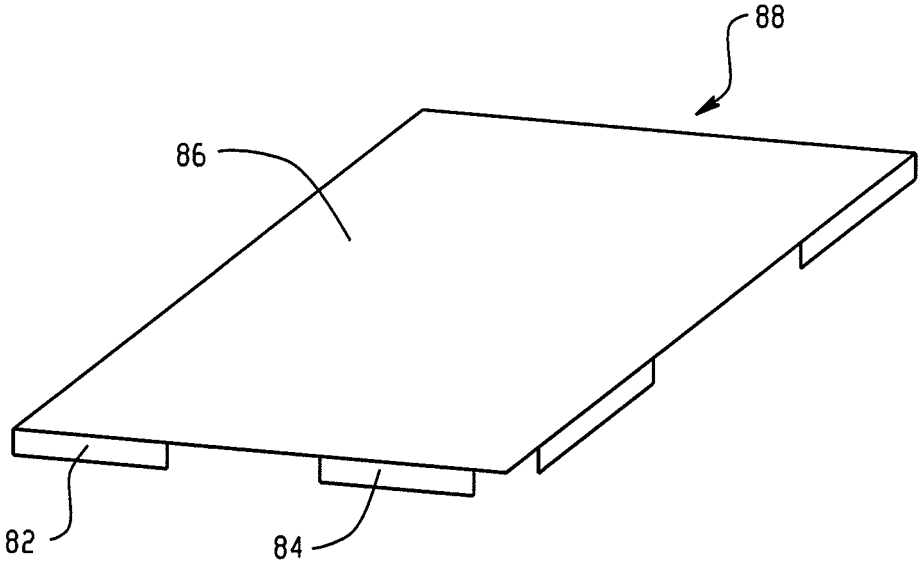
FIG. 6 illustrates an embodiment of a stacking component.
Figure 7:
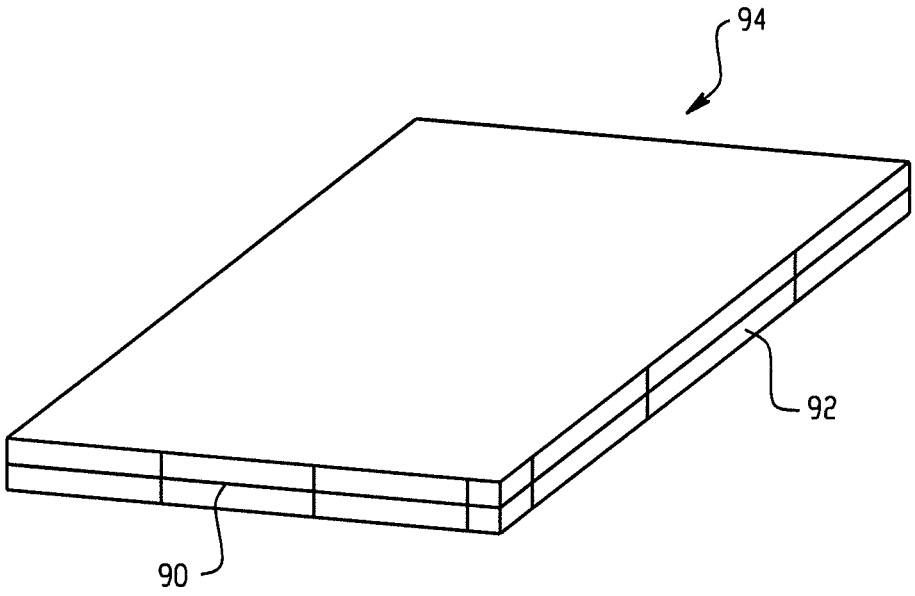
FIG. 7 illustrates another embodiment of a stacking component.

While the side walls of the stacking and base components are shown as being continuous and extending from side to side of the stacking and base components, other configurations are contemplated. For example, FIG. 6 shows multiple, spaced apart side wall portions 82 and 84 extending downwardly from seating portion 86 at each side of stacking component 88. FIG. 7 shows a grid structure forming side walls 90 and 92 of stacking component 94. In another embodiment, the entire stacking component may be a mesh structure with side walls being bent portions of the mesh structure. Other variations are possible as well.

What is claimed is:

1. A steam oven assembly, comprising: a first steam oven including a housing having a top, a bottom and sides extending from the top to the bottom, a cooking cavity within the housing and a door having an open configuration and a closed configuration; a second steam oven including a housing having a top, a bottom and sides extending from the top to the bottom, a cooking cavity within the housing and a door having an open configuration and a closed configuration, the second steam oven stacked on top of the first steam oven; and a stacking component located between the first and second steam ovens, the stacking component including a substantially planar seating surface on which the second steam oven sits and being configured such that the stacking component nests with the top of the first steam oven to inhibit sliding movement of the second steam oven relative to the first steam oven; wherein the stacking component is formed separate from and secured to the first or second steam oven, the stacking component having four perimeter side walls extending downward from the seating surface to form an upwardly extending cavity at the bottom of the stacking component that receives an upper end of the first steam oven in a nested manner, the four perimeter side walls extending downward along respective sides of the housing of the first steam oven, the stacking component secured to the bottom of the second steam oven, the stacking component including at least one opening in the seating surface for passing a conduit between first steam oven and the second steam oven.

2. The steam oven assembly of claim 1, wherein each side wall of the stacking component is substantially perpendicular to an adjacent side wall of the stacking component.

3. The steam oven assembly of claim 1, wherein the stacking component is formed of a sheet of material that is metal, wherein a central portion of the sheet of material forms the seating surface and each side wall is a bent portion of the sheet material.

4. The steam oven assembly of claim 1 further comprising a base component including a seating surface on which the first steam oven sits, the base component being substantially identical to the stacking component.

5. The steam oven assembly of claim 4, wherein the stacking component and the base component each comprise a metal sheet material and include four side walls that are bent portions of the metal sheet material.

6. The steam oven assembly of claim 4 further comprising a plurality of castors each including a portion that extends through an associated opening in the seating surface of the base component.

7. The steam oven assembly of claim 1 further comprising a conduit passageway through which a conduit extends through both the first oven and the second oven, the stacking component including an opening through which the conduit extends from the second oven to the first oven.

8. A steam oven assembly, comprising: a steam oven including a housing having a top, a bottom and outer sides extending from the top to the bottom, a cooking cavity within the housing and a door having an open configuration and a closed configuration; a base component secured to the bottom of the steam oven, the base component including a seating surface engaged with the bottom of the steam oven and four perimeter side walls extending downward from the seating surface to form and upwardly extending cavity at the bottom of the base component; wherein said four perimeter sidewalls are positioned outward of the outer sides of said steam oven a second steam oven including a housing having a top, a bottom and outer sides extending from the top to the bottom, a cooking cavity within the housing and a door having an open configuration and a closed configuration, the first steam oven stacked on top of the second steam oven such that the base component nests with the top of the second steam oven to inhibit sliding movement of the first steam oven relative to the second steam oven, with the perimeter sidewalls extending downward alongside respective outer sides of the second steam oven, the base component including at least one opening in the seating surface for passing a conduit between the first and second steam ovens.

9. The steam oven assembly of claim 8 wherein the second steam oven includes a base component secured to the bottom of the second steam oven, the base component of the second steam oven substantially identical in configuration to the base component of the first steam oven.

10. The steam oven assembly of claim 9, wherein each base component comprises a metal sheet material and includes four side walls that are bent portions of the metal sheet material.

11. A method of assembling a stacked steam oven construction, the method comprising: (a) providing a first steam oven including a housing having a top, a bottom and sides extending from the top to the bottom, a cooking cavity within the housing and a door having an open configuration and a closed configuration; (b) providing a second steam oven including a housing having a top, a bottom and sides extending from the top to the bottom, a cooking cavity within the housing and a door having an open configuration and a closed configuration; (c) securing a separately formed stacking component to the bottom of the first steam oven, the stacking component including a downward facing cavity, the stacking component formed of a metal sheet material and includes four side walls that are bent portions of the metal sheet material; (d) stacking the first steam oven atop the second steam oven such that the downward facing cavity of the stacking component nests with the top of the second steam oven to inhibit sliding movement of the second steam oven relative to the first steam oven; (e) passing at least one conduit that provides fluid communication between the first and second steam ovens through at least one opening located on a planar surface of the stacking component.

* * * * *